US008577269B2

(12) United States Patent
Takahashi

(10) Patent No.: US 8,577,269 B2
(45) Date of Patent: Nov. 5, 2013

(54) IMAGE FORMING APPARATUS

(75) Inventor: Masahiro Takahashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 84 days.

(21) Appl. No.: 13/410,686

(22) Filed: Mar. 2, 2012

(65) Prior Publication Data

US 2012/0251204 A1 Oct. 4, 2012

(30) Foreign Application Priority Data

Mar. 29, 2011 (JP) ..... 2011-071781

(51) Int. Cl.
*G03G 15/20* (2006.01)

(52) U.S. Cl.
USPC ..... 399/322; 399/323

(58) Field of Classification Search
USPC ..... 399/67, 323, 322, 320, 398, 399; 358/1.13; 271/307, 308, 311–313, 900
See application file for complete search history.

(56) References Cited

U.S. PATENT DOCUMENTS 4,168,902 A * 9/1979 Golz ..... 399/399
7,580,664 B2 * 8/2009 Howe ..... 399/323
7,974,563 B2 7/2011 Sakai et al.
8,005,413 B2 8/2011 Sakakibara et al.
2002/0141792 A1 * 10/2002 Nakano et al. ..... 399/323
2009/0060605 A1 * 3/2009 Ohkushi et al. ..... 399/363
2011/0091252 A1 4/2011 Sekihara et al.
2011/0217092 A1 9/2011 Sekihara et al.
2011/0237413 A1 9/2011 Sakakibara et al.
2012/0051806 A1 3/2012 Takahashi

FOREIGN PATENT DOCUMENTS

JP 02-129680 A 5/1990
JP 2005-351939 A 12/2005

* cited by examiner

*Primary Examiner* — Clayton E LaBalle
*Assistant Examiner* — Victor Verbitsky
(74) *Attorney, Agent, or Firm* — Fitzpatrick, Cella, Harper & Scinto

(57) ABSTRACT

Driving of a driving unit is controlled so as to satisfy relationship of $L>|X+Y|$ ($|X|\leq X0$, $|Y|\leq Y0$), wherein a distance between an outside end of a separation claw in a width direction when a fixing unit and the separation claw are at respective reference positions and a side end of a sheet, which is winding around a heating roller, in the width direction is L, a displacing amount of the fixing unit detected by a first detecting unit is X, a maximum displacing amount of the fixing unit is X0, a displacing amount of the separation claw detected by a second detecting unit is Y, and a maximum displacing amount of the separation claw is Y0.

6 Claims, 10 Drawing Sheets

IMAGE FORMING APPARATUS

BACKGROUND OF THE INVENTION

1. Field of the Invention

The present invention relates to an image forming apparatus and more specifically relates to an image forming apparatus including a fixing unit that separates a sheet from a heating roller by a separation claw.

2. Description of the Related Art

Conventionally, as an image forming apparatus such as a copying machine, a printer, or a facsimile, there is an image forming apparatus forming an image by an electrophotography technique. In a case where an image is formed on a sheet by the image forming apparatus, a toner image is first formed on an image bearing member. The toner image is thereafter fixed permanently on a sheet to form an image on the sheet by toner.

The most effective method to fix the toner image permanently on the sheet is fusing powdered toner by applying heat and applying pressure so as to compress the toner and the sheet. Thus, the image forming apparatus using the electrophotographic process generally includes a fixing unit having a heating roller and a pressurizing roller as a means for fixing the toner image permanently on the sheet. In a case of fixing the toner image, the sheet to which the toner image has been transferred is made to enter a fixing nip portion formed by the heating roller and the pressurizing roller to heat, press, and fix the toner image on the sheet.

In the fixing unit, there is a case in which the sheet winds around the heating roller at the time of fixing. In order to prevent the sheet from winding around the heating roller, a configuration in which a separation claw is made to contact with the heating roller to separate the sheet from the heating roller by the separation claw is widely known.

At the time of fixing the toner image on the sheet, the toner on the sheet is offset to the heating roller. The separation claw abuts on the heating roller in a static state at all times. Thus, the toner is stripped off by the separation claw that abuts on the heating roller in a static state at all times and thereafter accumulates at the tip end portion of the separation claw. The toner accumulated at the separation claw is eventually hardened like a blade edge formed in a sharp wave shape since it accumulates unevenly. The hardened toner accelerates partial abrasion of the heating roller or scratches the heating roller.

Conventionally, as a means for solving this problem, a configuration of reciprocating the separation claw continuously or intermittently at constant speed in an axial direction of the heating roller while making the separation claw abut on the heating roller is proposed. This technique is disclosed in Japanese Patent Application Laid-Open No. H02-129680.

Also, conventionally, the heating roller and the pressurizing roller are held between frames provided in the fixing unit and cannot move in a width direction perpendicular to a sheet conveying direction, that is, an axial direction of each roller. Accordingly, when the sheet passes through the fixing nip portion, the end portion of the sheet passes the same positions of the heating roller and the pressurizing roller. Due to the contact with the sheet end portion at the time of passing, the heating roller and the pressurizing roller are abraded to shorten their longevity. As a means for solving this problem, a configuration of reciprocating the heating roller and the pressurizing roller continuously or intermittently at constant speed in their axial directions is proposed. This technique is disclosed in Japanese Patent Application Laid-Open No. 2005-351939.

In a case of reciprocating the heating roller and the pressurizing roller, the separation claw is held on the image forming apparatus main body. When the heating roller and the pressurizing roller reciprocate, the separation claw relatively reciprocates continuously or intermittently at constant speed in an axial direction of the heating roller while abutting on the heating roller. This prevents the heating roller from being partially abraded or scratched by the separation claw.

In a conventional image forming apparatus, when improvement in longevity of the rollers is attempted, the moving amount(s) of the separation claw or the heating roller and the pressurizing roller must be increased. In a case where the moving amount of the separation claw or the like is increased, the position of the separation claw, which should originally be sufficiently away from the sheet end portion, may be overlapped with the position of the sheet end portion (corner portion of the tip end). In a case where the position of the separation claw is overlapped with the position of the sheet end portion, the separation claw may cause corner folding of the sheet or sheet jam.

The present invention is accomplished by taking these circumstances into consideration thereof, and an object thereof is to provide an image forming apparatus improving longevity of a heating roller and enabling to prevent generation of corner folding and jam of a sheet.

SUMMARY OF THE INVENTION

The present invention provides an image forming apparatus including: a fixing unit which has a heating roller and a pressurizing roller pressure contacting with the heating roller, and which fixes a toner image on a sheet onto the sheet at a nip portion between the heating roller and the pressurizing roller; a separation claw which is provided so as to contact with the heating roller, and which separates the sheet onto which the toner image has been fixed from the heating roller; a fixing unit moving portion which reciprocates the fixing unit in a width direction perpendicular to a sheet conveying direction; a separation claw moving portion which reciprocates the separation claw in the width direction; a displacing amount detecting portion for the fixing unit which detects a displacing amount from a reference position of the fixing unit in the width direction; a displacing amount detecting portion for the separation claw which detects a displacing amount from a reference position of the separation claw in the width direction; and a control unit which controls driving of the fixing unit moving portion and the separation claw moving portion based on information from the displacing amount detecting portion for the fixing unit and the displacing amount detecting portion for the separation claw so as to satisfy the following relationship, $$L > |X+Y| \ (|X| \leq X0,\ |Y| \leq Y0)$$

wherein a distance between an outside end of the separation claw in the width direction when the fixing unit and the separation claw are at the respective reference positions and a side end of the sheet conveyed at the reference positions in the width direction is L, wherein the displacing amount of the fixing unit detected by the displacing amount detecting portion for the fixing unit is X, wherein a maximum displacing amount of the fixing unit is X0, wherein the displacing amount of the separation claw detected by the displacing amount detecting portion for separation claw is Y, and wherein a maximum displacing amount of the separation claw is Y0.

The present invention also provides an image forming apparatus including: a fixing unit which has a heating roller and a pressurizing roller pressure contacting with the heating roller, and which fixes a toner image on a sheet onto the sheet at a nip portion between the heating roller and the pressurizing roller; a separation claw which is provided so as to contact with the heating roller, and which separates the sheet onto which the toner image has been fixed from the heating roller; a sheet conveying portion which conveys the sheet to the fixing unit; a sheet conveying portion moving portion which reciprocates the sheet conveying portion in a width direction in a state of nipping the sheet so as to change a position of the sheet to be conveyed to the fixing unit in the width direction perpendicular to a sheet conveying direction; a separation claw moving portion which reciprocates the separation claw in the width direction; a displacing amount detecting portion for the sheet conveying portion which detects a displacing amount from a reference position of the sheet conveying portion in the width direction; a displacing amount detecting portion for the separation claw which detects a displacing amount from a reference position of the separation claw in the width direction; and a control unit which controls driving of the sheet conveying portion moving portion and the separation claw moving portion based on information from the displacing amount detecting portion for the sheet conveying portion and the displacing amount detecting portion for the separation claw so as to satisfy the following relationship, $$L>|Y-Z| \ (|Y|\leq Y0,\ |Z|\leq Z0)$$

wherein a distance between an outside end of the separation claw in the width direction when the sheet conveying portion and the separation claw are at the respective reference positions and a side end of the sheet conveyed at the reference positions in the width direction is L, wherein the displacing amount of the sheet conveying portion is Z, wherein a maximum displacing amount of the sheet conveying portion is Z0, wherein the displacing amount of the separation claw is Y, and wherein a maximum displacing amount of the separation claw is Y0.

The present invention further provides an image forming apparatus including: a fixing unit which has a heating roller and a pressurizing roller pressure contacting with the heating roller, and which fixes a toner image on a sheet onto the sheet at a nip portion between the heating roller and the pressurizing roller; a separation claw which is provided so as to contact with the heating roller, and which separates the sheet onto which the toner image has been fixed from the heating roller; a sheet conveying portion which conveys the sheet to the fixing unit; a sheet conveying portion moving portion which reciprocates the sheet conveying portion in a width direction in a state of nipping the sheet so as to change a position of the sheet to be conveyed to the fixing unit in the width direction perpendicular to a sheet conveying direction; a fixing unit moving portion which reciprocates the fixing unit in the width direction; a separation claw moving portion which reciprocates the separation claw in the width direction; a displacing amount detecting portion for the sheet conveying portion which detects a displacing amount from a reference position of the sheet conveying portion in the width direction; a displacing amount detecting portion for the fixing unit which detects a displacing amount from a reference position of the fixing unit in the width direction; a displacing amount detecting portion for the separation claw which detects a displacing amount from a reference position of the separation claw in the width direction; and a control unit which controls driving of the sheet conveying portion moving portion, the fixing unit moving portion and the separation claw moving portion based on information from the displacing amount detecting portion for the sheet conveying portion, the displacing amount detecting portion for the fixing unit and the displacing amount detecting portion for the separation claw so as to satisfy the following relationship, $$L>|(X+Y)-Z| \ (|X|\leq X0,\ |Y|\leq Y0,\ |Z|\leq Z0)$$

wherein a distance between an outside end of the separation claw in the width direction when the sheet conveying portion, the fixing unit and the separation claw are at the respective reference positions and a side end of the sheet conveyed at the reference positions in the width direction is L, wherein the displacing amount of the sheet conveying portion is Z, wherein a maximum displacing amount of the sheet conveying portion is Z0, wherein the displacing amount of the fixing unit is X, wherein a maximum displacing amount of the fixing unit is X0, wherein the displacing amount of the separation claw is Y, and wherein a maximum displacing amount of the separation claw is Y0.

Further features of the present invention will become apparent from the following description of exemplary embodiments with reference to the attached drawings.

DESCRIPTION OF THE EMBODIMENTS

Embodiments of the present invention will now be described in detail in accordance with the accompanying drawings.

Figure 1:
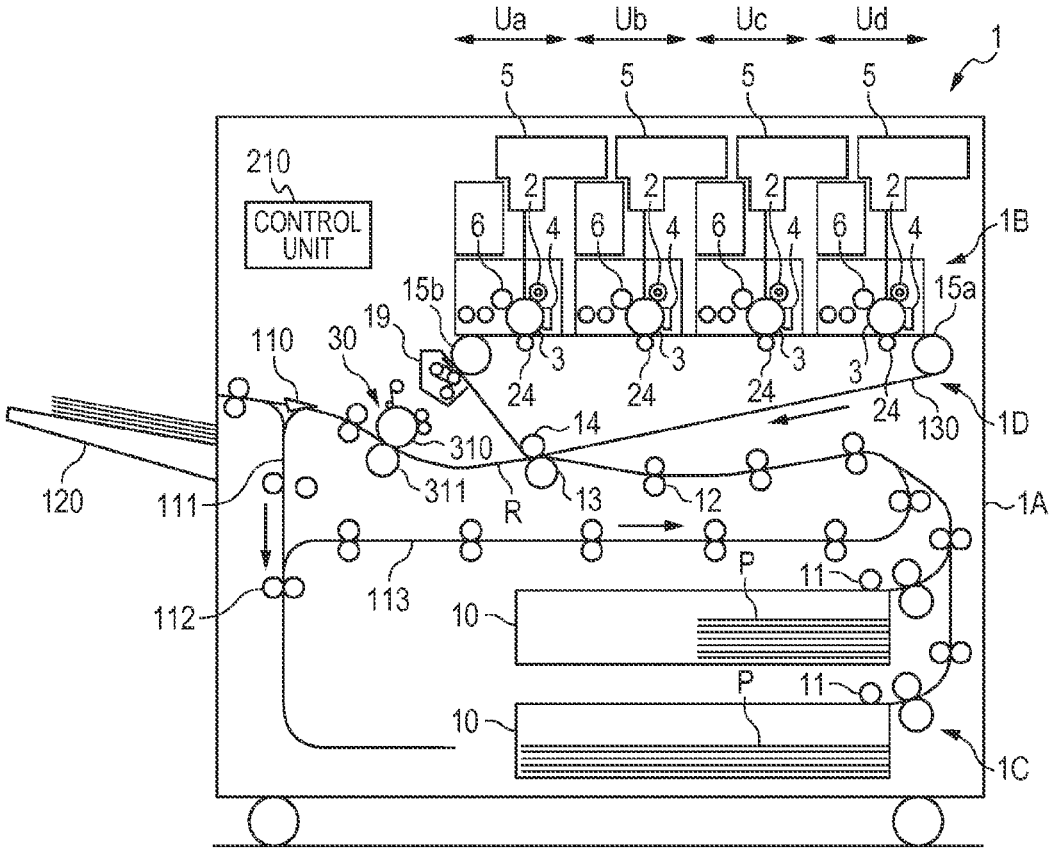
FIG. 1 illustrates a schematic configuration of a color image forming apparatus as an example of an image forming apparatus according to a first embodiment of the present invention.

FIG. 1 illustrates a schematic configuration of a color image forming apparatus as an example of an image forming apparatus according to a first embodiment of the present invention. In FIG. 1, a color image forming apparatus 1 includes a color image forming apparatus main body (hereinafter referred to as an apparatus main body) 1A. The apparatus main body 1A includes an image forming portion 1B, a sheet feeding portion 1C conveying a sheet P, and a transfer portion 1D transferring a toner image formed in the image forming portion 1B to the sheet P fed by the sheet feeding portion 1C.

The image forming portion 1B has four image forming units U (Ua, Ub, Uc, and Ud) for yellow (Y), magenta (M), cyan (C), and black (Bk). Each image forming unit U has a photosensitive drum 3 as an image bearing member, a charging unit 2 charging the surface of the photosensitive drum uniformly, and an exposing unit 5 forming an electrostatic latent image on the charged photosensitive drum 3.

Each image forming unit U also has a developing unit 4 developing the electrostatic latent image on the photosensitive drum, a primary transfer roller 24 transferring the toner image on the photosensitive drum to an after-mentioned intermediate transfer belt 130, a photosensitive member cleaner 6 removing residual toner on the photosensitive drum, and the like. That is, the color image forming apparatus 1 of the present embodiment is in an intermediate transfer tandem type, in which the image forming units U for four-colors as the image forming portion 1B are arrayed and arranged above the after-mentioned intermediate transfer belt. Colors formed by the respective image forming units U are not limited to the four colors, and the arranging order of the colors is not limited to the above one.

The sheet feeding portion 1C includes a sheet feeding cassette 10 as a sheet storing portion storing the sheet P and a sheet feeding roller 11 feeding the sheet P stored in the sheet feeding cassette 10. The transfer portion 1D includes the intermediate transfer belt 130 stretched by a driving roller 15*a*, a tension roller 15*b*, and a secondary transfer inner roller 14 and driven to be rotated at equal circumferential speed to that of each photosensitive drum 3 in an arrow direction. A toner image formed on each photosensitive drum is transferred to the intermediate transfer belt 130 by a predetermined pressurizing force and electrostatic load bias given by each primary transfer roller 24. The intermediate transfer belt 130 gives the sheet P a predetermined pressurizing force and electrostatic load bias at a secondary transfer portion formed by the secondary transfer inner roller 14 and a secondary transfer outer roller 13 approximately opposed to each other to attract an unfixed image to the sheet P.

When an image is formed in the color image forming apparatus 1, the surface of each photosensitive drum 3 is first charged uniformly by the charging unit 2 in advance. Thereafter, image data is received at a computing control unit (CPU) 210 provided at a predetermined position in the apparatus main body 1A and is transmitted to each exposing unit 5. Each exposing unit 5 first emits laser light from a light source unit based on a transmitted signal of image information, thereafter scans with the laser light by rotating a polygon mirror, and deflects a light flux of the scanning light by a reflecting mirror. The exposing unit 5 subsequently irradiates the photosensitive drum 3 rotated in an anti-clockwise direction with the deflected laser light by an fθ lens to form a latent image on the surface of the photosensitive drum.

Subsequently, the electrostatic latent image formed on the photosensitive drum 3 undergoes toner development by the developing unit 4 to cause a toner image to be formed on the photosensitive drum. Thereafter, a predetermined pressurizing force and electrostatic load bias are given by each primary transfer roller 24, and a toner image is transferred to the intermediate transfer belt 130. Transfer residual toner slightly remaining on each photosensitive drum 3 is collected by the photosensitive member cleaner 6 so as for the photosensitive drum 3 to be prepared for the subsequent image formation.

The image formation by each image forming unit U in the image forming portion 1B is carried out at timing to overlap its image with an upstream toner image primarily transferred on the intermediate transfer belt 130. As a result, a full-color toner image is ultimately formed onto the intermediate transfer belt 130. The sheet P is conveyed from the sheet feeding cassette 10 by the sheet feeding roller 11 and is thereafter conveyed to a registration roller 12.

The sheet P undergoes at the registration roller skew feeding correction and timing correction and is thereafter conveyed to the secondary transfer portion formed by the secondary transfer inner roller 14 and the secondary transfer outer roller 13 approximately opposed to each other. Thereafter, a predetermined pressurizing force and electrostatic load bias are given at the secondary transfer portion to cause the full-color toner image to be secondarily transferred onto the sheet P. Toner and other foreign matter remaining on the intermediate transfer belt 130 are wiped off with a cleaning web (nonwoven cloth) 19 abutting on the surface of the intermediate transfer belt 130.

Subsequently, the sheet P, to which the toner image has been secondarily transferred, is guided by a sheet conveyance path R to a fixing unit 30 heating and fixing the toner image on the sheet. At the fixing unit 30, a predetermined pressurizing force by a heating roller 310 and a pressurizing roller 311 approximately opposed to each other and a heating effect by a heat source such as a heater in general are applied to cause the toner to be fused and fixed on the sheet P. The sheet P with a fixed image is thereafter discharged on a sheet discharging tray 120.

In a case of forming images on both sides of the sheet P, the sheet P is guided by a switching member 110 to a reverse path 111, is thereafter reversed by a reverse roller 112, and is guided to a duplex path 113. Subsequently, the sheet P passes through the registration roller 12, the secondary transfer portion, and the fixing unit 30 again, at the time of which a toner image is fixed on the back surface. The switching member 110 is switched by the time the image is formed on the back surface of the sheet, whereby the sheet P to which images have been fixed on both sides is discharged on the sheet discharging tray 120.

Figure 2:
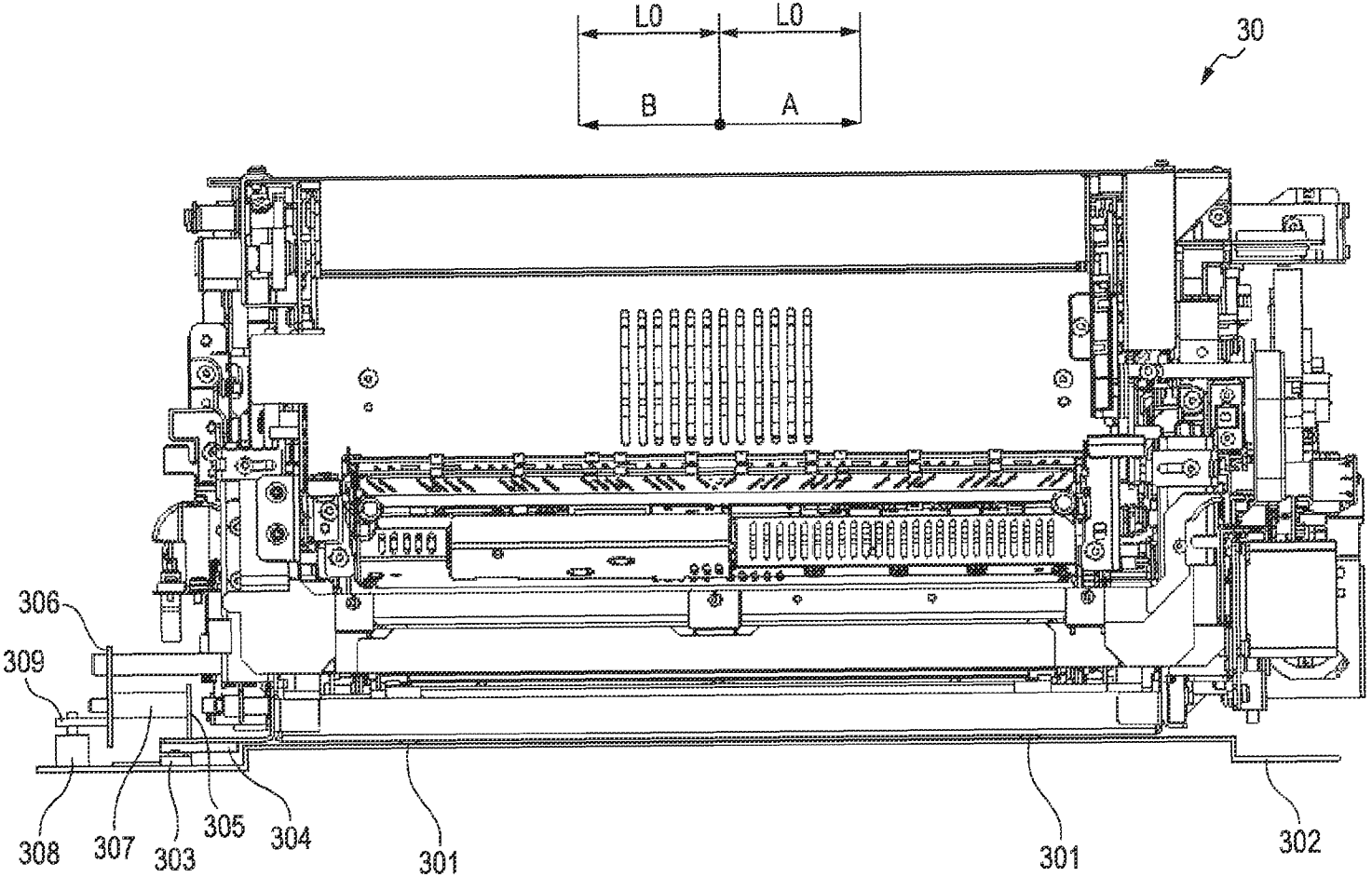
FIG. 2 is a first view illustrating a configuration of a fixing unit provided in the color image forming apparatus.

FIG. 2 illustrates the fixing unit 30 as seen from the sheet discharging port. In FIG. 2, a unit tray 302 is provided on the apparatus main body. The fixing unit 30 is supported by the unit tray 302 so as to be movable as much as distance L0 respectively in directions of arrows A and B, each of which is a width direction perpendicular to a sheet conveying direction, centering on a fixing reference position set at a center portion in a width direction of the sheet conveyance path R (refer to FIG. 1).

The fixing unit 30 is movably supported by the unit tray 302 via rollers 301 rotatably attached to the bottom portion. The fixing unit 30 is biased in the direction of arrow B with respect to the unit tray 302 at all times by a biasing member 307 provided between an attaching member 305 provided at the unit tray 302 and a receiving member 306 provided at the fixing unit 30.

To the unit tray 302 is attached a first detecting means 303 as a displacing amount detecting portion for the fixing unit that detects the position of the fixing unit 30 and detects the displacing amount of the fixing unit 30 from the fixing reference position as a center reference. To the fixing unit 30 is provided a detected member 304 in order for the first detecting means 303 to detect the position of the fixing unit 30. The first detecting means 303 can detect the position of the fixing unit 30 by detecting the detected member 304.

To the unit tray 302 are attached a driving unit 308, such as a motor, which is a fixing unit moving portion moving the fixing unit 30 in the width direction, and an eccentric cam 309 rotated by the driving unit 308. When the driving unit 308 is driven to rotate the eccentric cam 309, the fixing unit 30, which is biased in the direction of arrow B, reciprocates (reciprocating motion) as much as distance L0 in the directions of arrows A and B with reference to the fixing reference position. The reciprocating motion of the fixing unit 30 can change the position of the heating roller 310 with respect to the sheet. This can prevent the heating roller from being abraded or scratched due to contact with the sheet end portion.

Figure 3:
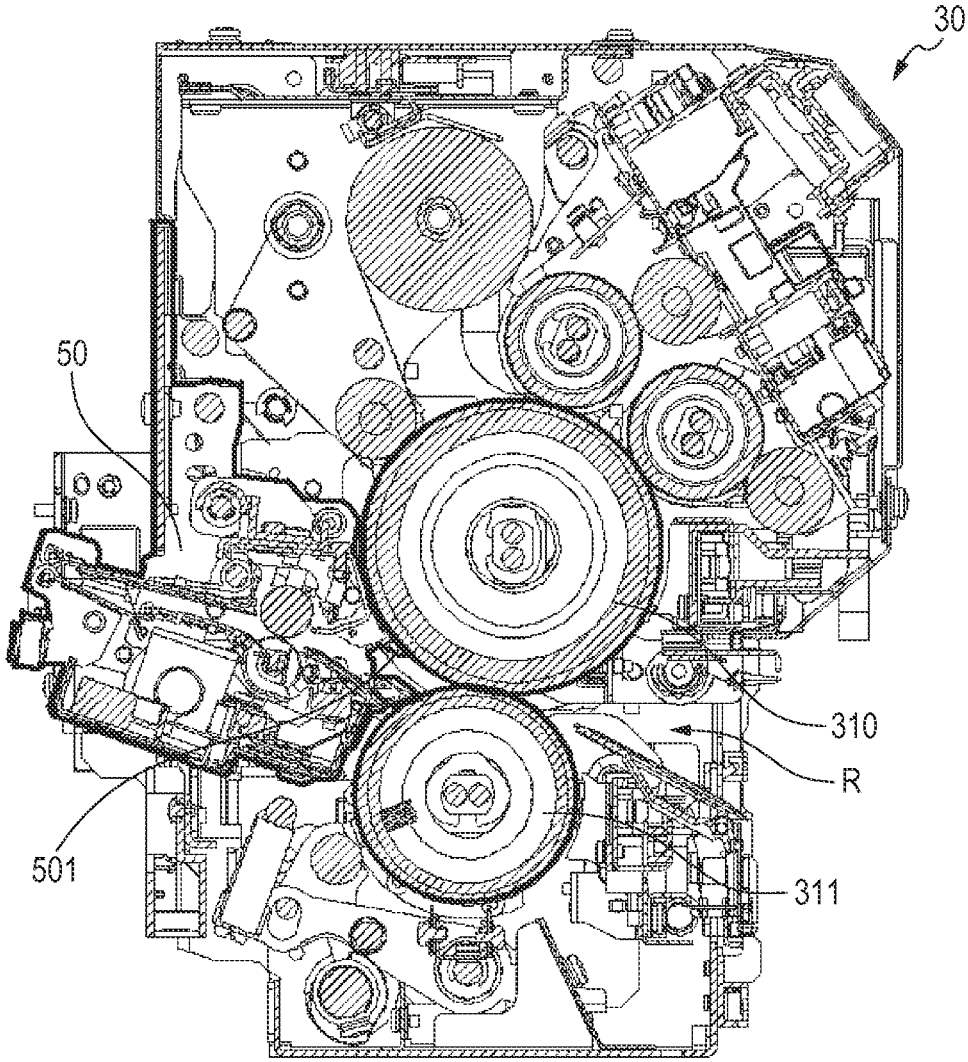
FIG. 3 illustrates a configuration of a separating sheet discharging unit provided in the fixing unit.
Figure 4:
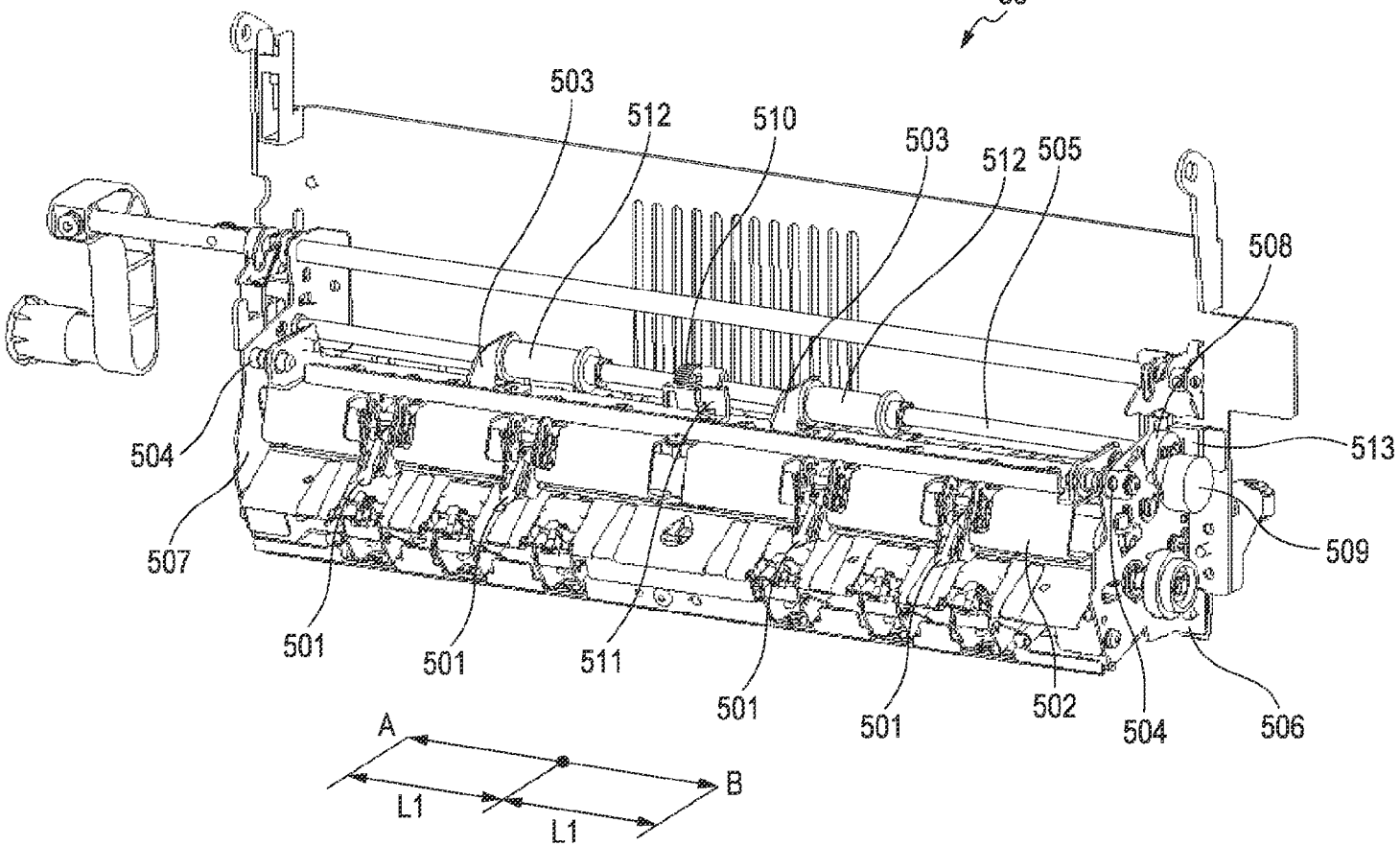
FIG. 4 is a second view illustrating the configuration of the separating sheet discharging unit.

The fixing unit 30 has provided therein a separating sheet discharging unit 50 as shown in FIG. 3. The separating sheet discharging unit 50 is provided with a separation claw 501 that prevents the sheet from winding around the heating roller 310 when the sheet is discharged from a fixing nip constituted by the heating roller 310 and the pressurizing roller 311 of the fixing unit 30. A plurality of separation claws 501 are provided symmetrically in a longitudinal direction (width direction) of the heating roller 301 centering on the center of the heating roller 310 in the width direction as shown in FIG. 4. Providing the separating sheet discharging unit 50 including the separation claws 501, which prevent the sheet from winding around the heating roller 310, in the fixing unit can secure high positional accuracy of the separation claws 501 with respect to the heating roller 310.

The separation claws 501 are fixed and attached to an upper guide 502 attached to an upper guide supporting member 503 as shown in FIG. 4. The upper guide supporting member 503 is supported by pins 504 and a thrust guide 505 to be able to reciprocate as much as distance L1 in directions of arrows A and B (that is, an axial direction of the heating roller) with reference to a separating reference position, which is the center of the separating sheet discharging unit 50 in the width direction. When the upper guide supporting member 503 moves in the directions of arrows A and B, the separation claws 501 also reciprocates integrally.

Figure 5:
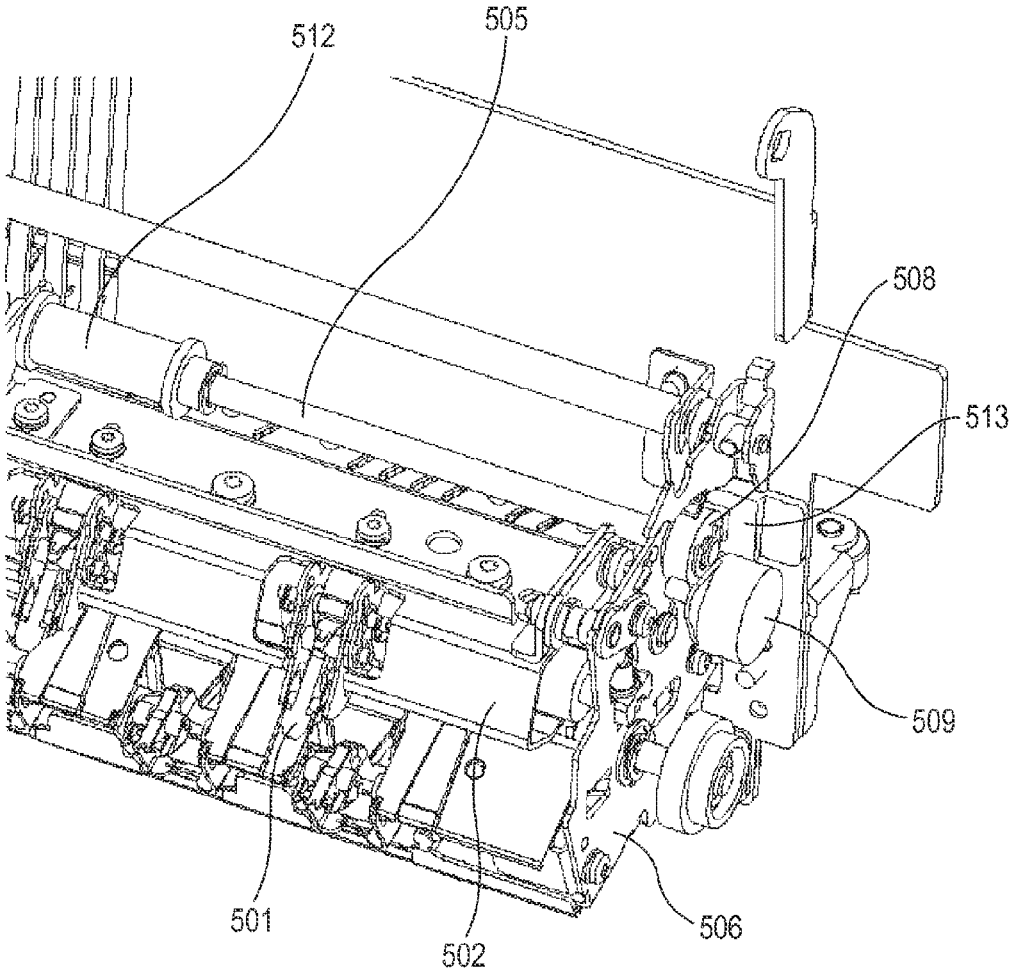
FIG. 5 is a third view illustrating the configuration of the separating sheet discharging unit.

The thrust guide 505 is rotatably provided to side plates 506 and 507 of the separating sheet discharging unit 50. To one end portion of the thrust guide 505 is attached a driving transmitting unit 508, as shown in FIG. 5. The driving transmitting unit 508 is connected to a driving unit 509. When the driving unit 509 is driven, the driving of the driving unit 509 is transmitted via the driving transmitting unit 508 to cause the thrust guide 505 to be rotated.

Figure 6:
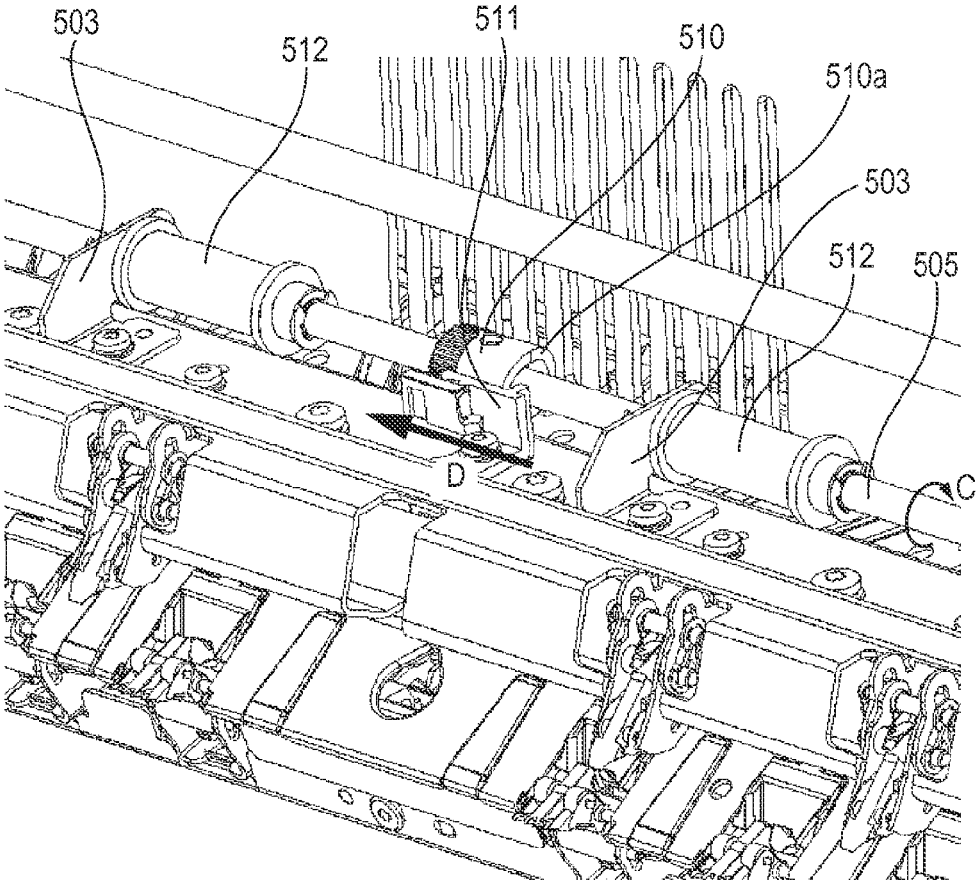
FIG. 6 is a fourth view illustrating the configuration of the separating sheet discharging unit.

As shown in FIG. 6, the thrust guide 505 is provided with a cam 510 while the upper guide supporting member 503 is provided with a thrusting member 511. By biasing means 512 such as springs provided on the thrust guide 505, the thrusting member 511 is biased in a direction of arrow D and presses a cam surface 510*a* provided on the cam 510.

Accordingly, when the thrust guide 505 is rotated in a direction of arrow C or in an opposite direction, the cam 510 is rotated. Thus, the thrusting member 511, which presses the cam surface 510*a*, thrusts and moves as much as distance L1 in the directions of arrows A and B in FIG. 4 in conformity with the shape of the cam surface 510*a*. Along with the movement of the thrusting member 511, the upper guide supporting member 503, the upper guide 502, and the separation claws 501 thrust move as much as distance L1 in the directions of arrows A and B. In the present embodiment, a separation claw moving portion reciprocating the separation claws 501 includes the driving transmitting unit 508, the driving unit 509, and the cam 510.

The driving transmitting unit 508 is provided with a second detecting unit 513 detecting phase of the thrust guide 505 as shown in FIG. 5. The second detecting unit 513 detects the position of the separation claws 501, that is, the displacing amount of the separation claws 501, from the cam phase that the second detecting unit 513 has detected. Meanwhile, the second detecting unit 513 is a displacing amount detecting portion for the separation claw that detects the displacing amount of the separation claws 501 from a separating reference position in a center reference. The second detecting unit 513 has, e.g., a gear that is rotated to mesh with the driving transmitting unit 508, and resistance that varies by rotation of the gear can be used.

Figure 7:
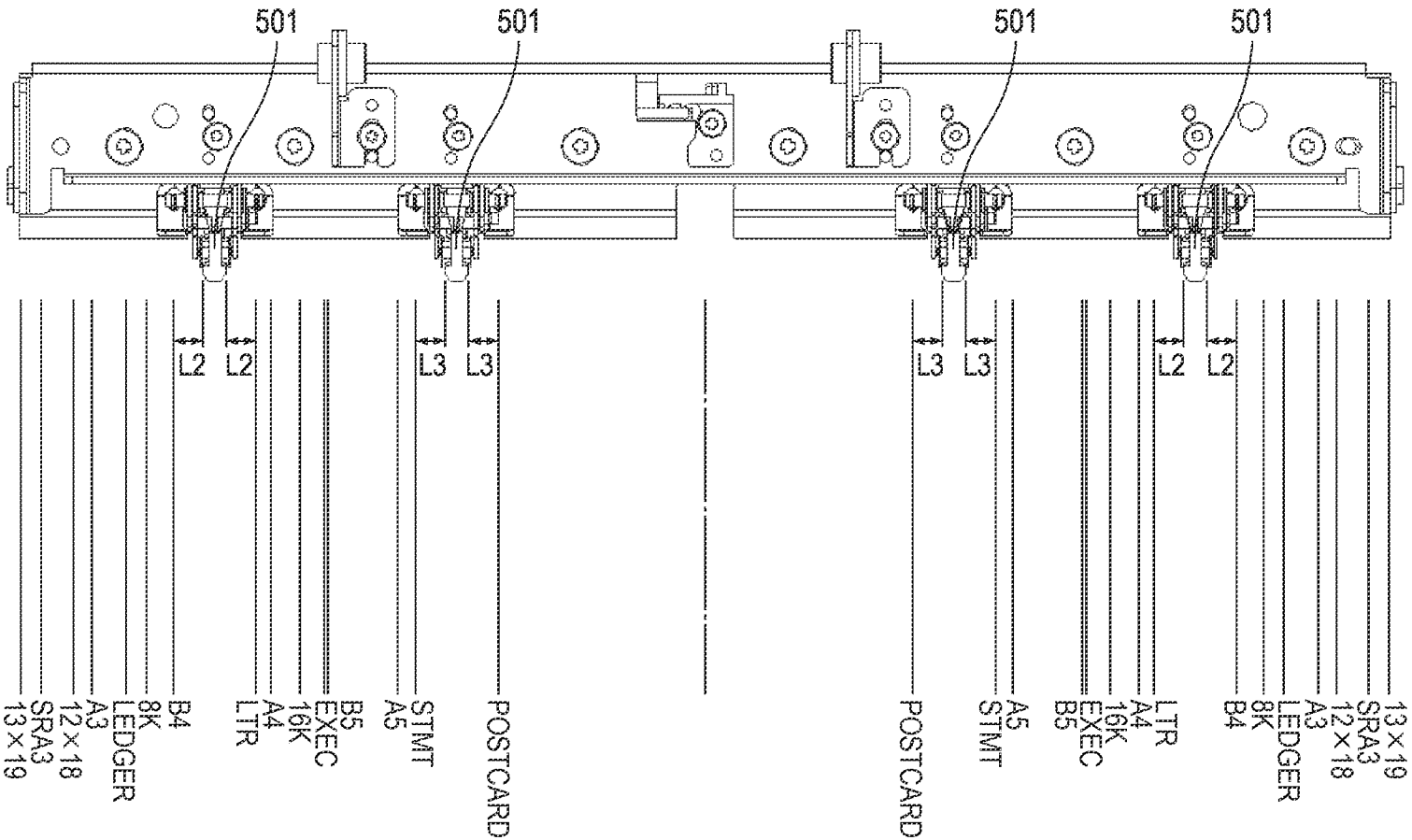
FIG. 7 illustrates positional relationship between separation claws provided in the fixing unit and sheet ends.

FIG. 7 illustrates positional relationship between positions of the separation claws 501 in the fixing unit 30 and positions of sheet ends in the present embodiment. The separation claws 501 are provided at positions as far as predetermined distances away from side end positions of sheets in the width direction to deal with various sheet sizes. In the present embodiment, each of the separation claws is provided at a center position between a postcard size end and an STMT size end or at a center position between an LTR size end and a B4 size end. It is also provided at a position in which a distance from a sheet side end to an outside end of the separation claw 501 in the width direction is L2 or L3.

When the fixing unit 30 performs the reciprocating motion by the driving unit 308 and the eccentric cam 309, the separating sheet discharging unit 50 also performs the reciprocating motion to the sheet conveyed at a predetermined position in a front-back direction of the apparatus main body in synchronization with the fixing unit 30. In other words, when the fixing unit 30 performs the reciprocating motion as much as distance L0 respectively in the directions of arrows A and B as shown in FIG. 2, the separating sheet discharging unit also performs the reciprocating motion as much as distance L0 respectively in the directions of arrows A and B in synchronization with the fixing unit 30.

At this time, the separation claws 501 perform the reciprocating motion to the heating roller provided in the fixing unit 30 as much as distance L1 respectively in the directions of arrows A and B as shown in FIG. 4. Meanwhile, the directions of arrows A and B shown in FIG. 2 are approximately equal directions to the directions of arrows A and B shown in FIG. 4. The reciprocating motion of the separation claws 501 in the directions of arrows A and B can keep to a minimum the contact abrasion of the heating roller caused by contact with the separation claws 501.

Figure 8:
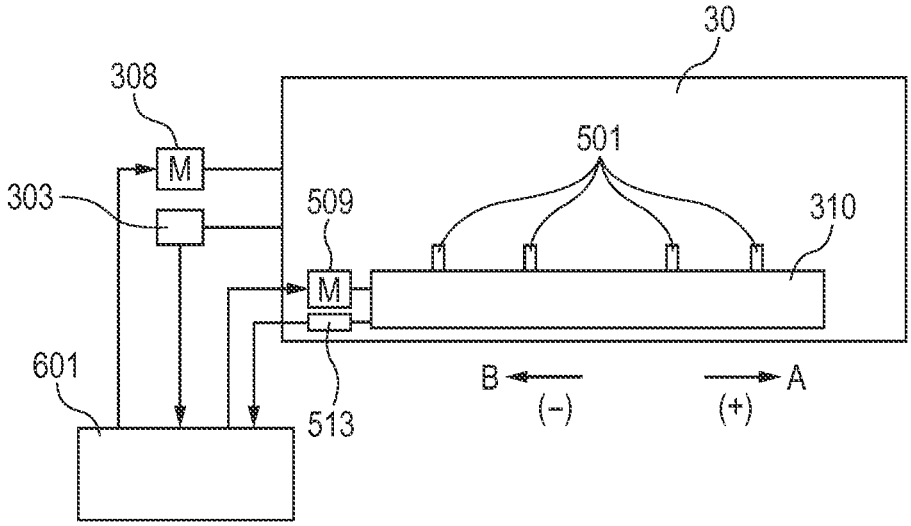
FIG. 8 illustrates a configuration to control thrust positions of the fixing unit and the separation claws.

FIG. 8 illustrates a configuration to control thrust positions of the fixing unit 30 and the separation claws 501. In FIG. 8, a control means 601 is a control unit controlling the thrust positions of the fixing unit 30 and the separation claws 501. To the control means 601 are connected the first detecting unit 303 and the second detecting unit 513. The control unit 601 controls the driving units 308 and 509 based on the positions of the fixing unit 30 and the separation claws 501 obtained from the respective detecting units 303 and 513 so that the end portions of the separation claws 501 may not be overlapped with side ends of the sheet. It is to be noted that the control unit 601 may be provided separately from the computing control unit (CPU) 210 or may be served by the CPU 210.

The control of the thrust positions of the fixing unit 30 and the separation claws 501 by the control unit 601 will be described specifically. In this control, the moving amount in the direction of arrow A is referred to as a positive (+) value while the moving amount in the direction of arrow B is referred to as a negative (−) value. When the thrust moving amount (displacing amount) of the fixing unit from the fixing reference position is X while the thrust moving amount (displacing amount) of the separation claws from the separating reference position is Y, X+Y becomes a position of the separation claws 501 with respect to the apparatus main body 1A.

The control unit 601 controls the driving unit 308 and the driving unit 509 so that the following equation may be established with the distance of L2 or L3 shown in FIG. 7, whichever is smaller, as L. That is, the control unit 601 controls the driving unit 308 and the driving unit 509 to position each separation claw 501 so that the above displacing amount is less than the distance from the sheet side end to the outside end of the separation claw 501 in the width direction.

$$L > |X+Y| \ (|X| \leq X0,\ |Y| \leq Y0)$$

X0 is the maximum thrust moving amount (maximum displacing amount) of the fixing unit from the fixing reference position and is L0. Y0 is the maximum thrust moving amount (maximum displacing amount) of the separation claws from the separating reference position and is L1.

Positioning each separation claw 501 so that the above displacing amount is less than the distance from the sheet side end to the outside end of the separation claw 501 in the width direction can prevent the separation claw 501 from being overlapped with the sheet end. Meanwhile, the thrust moving amount |X| of the fixing unit from the fixing reference position and the thrust moving amount |Y| of the separation claws from the separating reference position can be equal at all times in control, and the moving directions can be opposing directions of A direction and B direction in control. In this case, the thrust moving amount of the separation claws can be increased, damage to the surface of the heating roller by the separation claws can be reduced, and longevity of the heating roller can be improved.

As described above, in the present embodiment, the fixing unit 30 and the separation claws 501 reciprocate in the width direction. Reciprocating the fixing unit 30 and the separation claws 501 in the width direction can reduce damage to the surface of the heating roller and improve longevity of the heating roller 310. When the fixing unit 30 and the separation claws 501 are moved, each separation claw 501 is positioned so that the above displacing amount is less than the distance from the sheet side end to the outside end of the separation claw 501 in the width direction. This can prevent the separation claw 501 from being overlapped with the sheet end.

In other words, in the present embodiment, the fixing unit 30 and the separation claws 501 move over a wide range in the width direction. This can keep the contact abrasion of the heating roller 310 to a minimum to improve longevity of the heating roller 310 and can prevent generation of corner folding of the sheet or sheet jam caused by the overlap of each separation claw 501 with the sheet. This enables high-quality deliverables to be provided.

Figure 9:
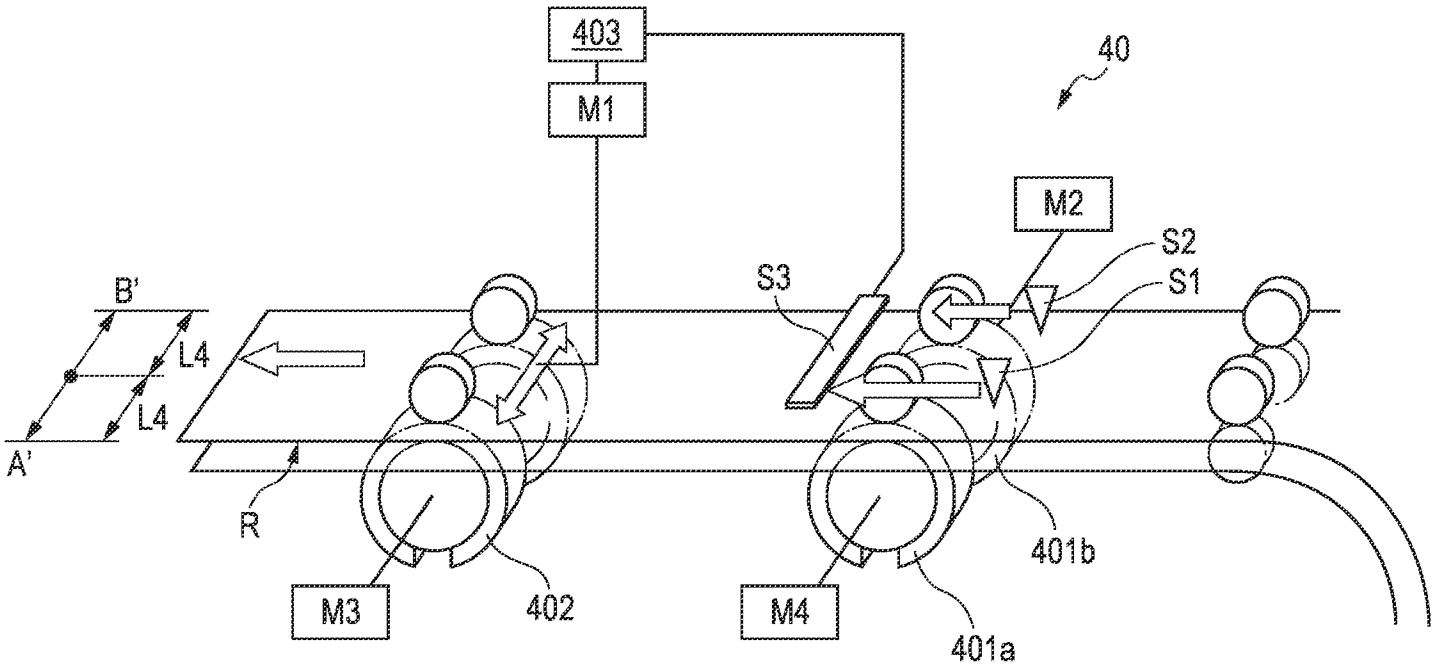
FIG. 9 is a schematic view of a registration unit provided in the image forming apparatus according to a second embodiment of the present invention.

A second embodiment of the present invention will be described. FIG. 9 is a schematic view of a registration unit provided in the image forming apparatus according to the present embodiment. In FIG. 9, a registration unit 40 conveys a sheet while correcting skew feeding. The registration unit 40 includes registration rollers 401*a* and 401*b*. The registration rollers 401*a* and 401*b* are respectively driven by driving units M2 and M4.

On the upstream of the registration rollers 401*a* and 401*b* in the sheet conveying direction are provided sensors S1 and S2 to detect front end position of the sheet. In the registration unit 40, the sensors S1 and S2 calculate a skew of the sheet from a difference (time difference) in timing when the sensors S1 and S2 detect the sheet front end and adjust the driving amounts of the driving units M2 and M4 to correct the sheet front end to be perpendicular to the sheet conveying direction.

On the downstream of the registration rollers 401*a* and 401*b* in the sheet conveying direction is provided a sensor S3 that detects the position of the sheet in the width direction. On the downstream of the sensor S3 in the sheet conveying direction is provided a conveying roller 402 as a sheet conveying portion that conveys the sheet and moves by a driving unit M1 in the width direction in a state of nipping the sheet. A control unit 403 controls a position of the conveying roller 402 based on positional information from the sensor S3. The control of driving of the driving unit M1 by the control unit 403 causes the conveying roller 402 to reciprocate in the width direction in a state of nipping the sheet.

In the registration unit 40, after the skew is corrected at the registration rollers 401*a* and 401*b*, the control unit 403 detects the side end positions of the sheet in the width direction by the sensor S3. Based on this detection result, the control unit 403 drives the driving unit M1 and moves the conveying roller 402 in a state of nipping the sheet in a range of distance L4 in directions of arrows A' and B' from a conveying reference position as a center in the width direction. Thereby, the sheet reciprocates so as to be located in a predetermined position range.

That is, in the present embodiment, the conveying roller 402 is reciprocated in a range of distance L4 respectively in the directions of arrows A' and B' shown in FIG. 9 by the driving unit M1, which constitutes a sheet conveying portion moving portion, and the position of the sheet is sequentially moved (changed). In the present embodiment, the separation claws 501 perform the reciprocating motion as much as distance L1 respectively in the directions of arrows A and B shown in FIG. 4 to the heating roller to keep the contact abrasion of the heating roller to a minimum in a similar manner to that of the first embodiment.

Figure 10:
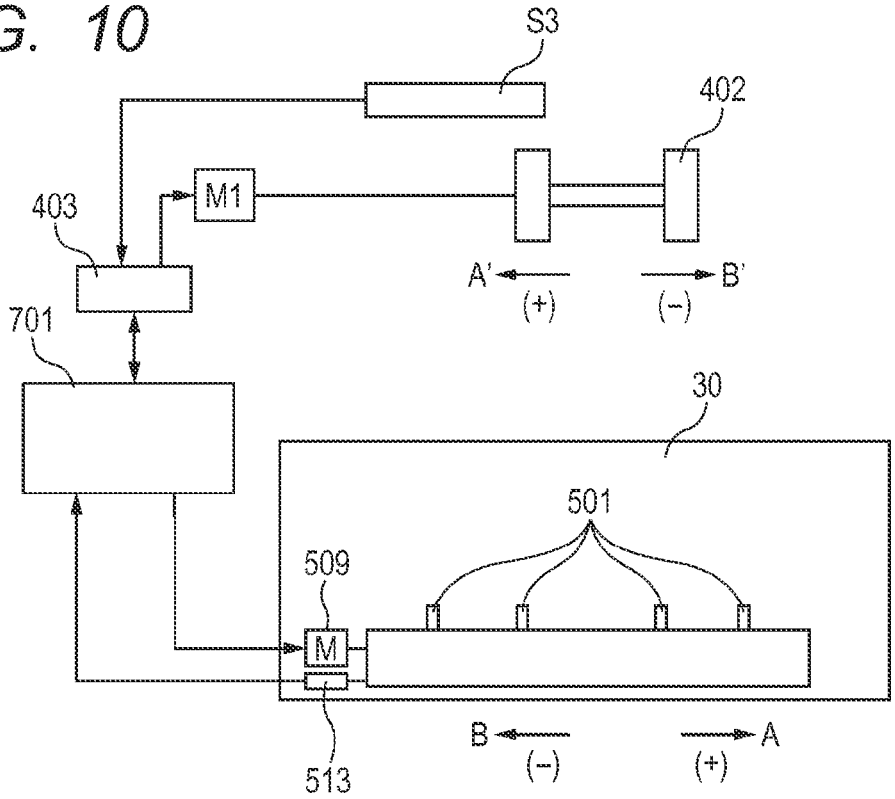
FIG. 10 illustrates a configuration to control thrust positions of the registration unit and the separation claws.

FIG. 10 illustrates a configuration to control thrust positions of the conveying roller 402 of the registration unit 40 and the separation claws 501. In FIG. 10, the same reference numerals as those in FIG. 8 represent identical or corresponding components. In FIG. 10, a control unit 701 controls the thrust positions of the conveying roller 402 and the separation claws 501. To the control unit 701 are connected the second detecting unit 513, the driving unit 509, and the control unit 403 of the registration unit 40.

The control unit 701 controls the driving unit 509 and the driving unit M1 based on the positions of the conveying roller 402 and the separation claws 501 obtained from the second detecting unit 513 and the control unit 403 so that the separation claws 501 may not be overlapped with the sheet. In the present embodiment, a sheet conveying portion displacing amount detecting portion that detects the displacing amount of the conveying roller 402 from the conveying reference position in the width direction is constituted by the sensor S3.

The control of the thrust positions of the conveying roller 402 and the separation claws 501 by the control unit 701 will be described specifically. In this control, the moving amount in the direction of arrow A or A' in the figure is referred to as a positive value while the moving amount in the direction of arrow B or B' is referred to as a negative value. When the thrust moving amount of the conveying roller 402 (in other words, the thrust moving amount from the conveying reference position of the sheet) is Z while the thrust moving amount of the separation claws from the separating reference position is Y, Y−Z is a position of the separation claws 501 with respect to the sheet.

The control unit 701 controls the driving unit M1 via the driving unit 509 and the control unit 403 so that the following equation may be established with the distance of L2 or L3 shown in FIG. 7, whichever is smaller, as L.

That is, the control unit 701 controls the driving unit 509 and the driving unit M1 to position each of the conveying roller 402 and the separation claws 501 so that the above displacing amount is less than the distance from the sheet side end to the outside end of the separation claw 501 in the width direction.

$$L>|Y-Z|\ (|Y|\leq Y0,\ |Z|\leq Z0)$$

Z0 is the maximum thrust moving amount (maximum displacing amount) of the conveying roller 402 from the conveying reference position and is L4. Y0 is the maximum thrust moving amount (maximum displacing amount) of the separation claws 501 from the separating reference position and is L1.

Positioning each the conveying roller 402 and the separation claw 501 so that the above displacing amount is less than the distance from the sheet side end to the outside end of the separation claw 501 in the width direction can prevent the separation claw 501 from being overlapped with the sheet end. Meanwhile, the thrust moving amount |Z| of the sheet from the conveying reference position and the thrust moving amount |Y| of the separation claws from the separating reference position can be equal at all times in control, and the moving directions can be equal directions in control. In this case, the thrust moving amount of the separation claws can be increased, damage to the surface of the heating roller by the separation claws can be reduced, and longevity of the heating roller can be improved.

As described above, in the present embodiment, the conveying roller 402 and the separation claws 501 reciprocate in the width direction. Reciprocating the conveying roller 402 and the separation claws 501 in the width direction can reduce damage to the surface of the heating roller and improve longevity of the heating roller. When the conveying roller 402 and the separation claws 501 are to move, each separation claw 501 is positioned so that the above displacing amount is less than the distance from the sheet side end to the outside end of the separation claw 501 in the width direction. This can prevent the separation claw 501 from being overlapped with the sheet end.

In other words, in the present embodiment, fixing unit 30 and the conveying roller 402 moves over a wide range in the width direction in a state of nipping the sheet. This can keep the contact abrasion of the heating roller 310 to a minimum to improve longevity of the heating roller 310 and can prevent generation of corner folding of the sheet or sheet jam caused by the overlap of each separation claw 501 with the sheet. This enables high-quality deliverables to be provided.

Figure 11:
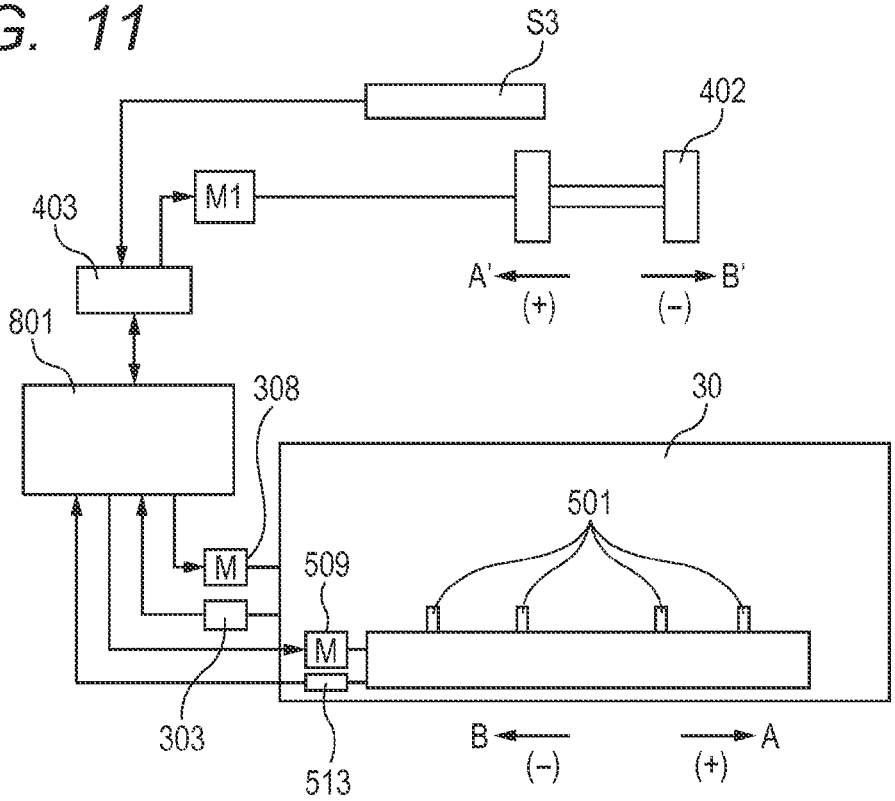
FIG. 11 illustrates a configuration to control thrust positions of the fixing unit, a conveying roller, and the separation claws of the image forming apparatus according to a third embodiment of the present invention.

A third embodiment of the present invention will be described. FIG. 11 illustrates a configuration to control thrust positions of the fixing unit, the conveying roller, and the separation claws of the image forming apparatus according to the present embodiment. In FIG. 11, the same reference numerals as those in FIGS. 8 and 10 represent identical or corresponding components.

In FIG. 11, a control unit 801 controls the thrust positions of the fixing unit 30, the registration roller 402, and the separation claws 501. To the control unit 801 are connected the first detecting unit 303, the second detecting unit 513, the driving unit 308, the driving unit 509, and the control unit 403 of the conveying roller 402. The control unit 801 controls the driving unit 308 and the driving unit 509 based on the positions of the fixing unit 30 and the separation claws 501 obtained from the respective detecting units 303 and 513 so that the separation claws 501 may not be overlapped with the sheet. The control unit 801 also controls the driving unit M1 via the control unit 403 based on the position of the conveying roller 402 or the position of the sheet obtained from the control unit 403 so that the separation claws 501 may not be overlapped with the sheet.

In the present embodiment as well, when the fixing unit 30 performs the reciprocating motion as much as distance L0 respectively in the directions of arrows A and B as shown in FIG. 2, the separation claws 501 also perform the reciprocating motion as much as distance L0 respectively in the directions of arrows A and B in synchronization with the fixing unit 30. The conveying roller 402 performs the reciprocating motion in a range of distance L4 respectively in the directions of arrows A' and B' shown in FIG. 9 so as to move the position of the sheet sequentially. The separation claws 501 perform the reciprocating motion as much as distance L1 respectively in the directions of arrows A and B shown in FIG. 4 to the heating roller.

The control of the thrust positions of the fixing unit 30, the conveying roller 402, and the separation claws 501 by the control unit 801 will be described specifically. In this control, the moving amount in the direction of arrow A or A' in the figure is referred to as a positive value while the moving amount in the direction of arrow B or B' is referred to as a negative value.

When the thrust moving amount of the fixing unit from the fixing reference position is X, the thrust moving amount of the separation claws from the separating reference position is Y, and the thrust moving amount of the conveying roller 402 (in other words, the thrust moving amount from the conveying reference position of the sheet) is Z, (X+Y)−Z is a position of the separation claws with respect to the sheet.

The control unit 801 controls the driving unit M1 via the driving unit 509 and the control unit 403 so that the following equation may be established with the distance of L2 or L3 shown in FIG. 7, whichever is smaller, as L. That is, the control unit 801 controls the driving unit 308, the driving unit 509, and the driving unit M1 to position each of the fixing unit 30, the conveying roller 402, and the separation claws 501 so that the above displacing amount is less than the distance from the sheet side end to the outside end of the separation claw 501 in the width direction.

$$L>|(X+Y)-Z|\ (|X|\leq X0,\ |Y|\leq Y0,\ |Z|\leq Z0)$$

Positioning each of the fixing unit 30, the conveying roller 402, and the separation claws 501 so that the above displacing amount is less than the distance from the sheet side end to the outside end of the separation claw 501 in the width direction can prevent the separation claw 501 from being overlapped with the sheet end. Meanwhile, the thrust moving direction of the fixing unit and the thrust moving direction of the separation claws can be opposing directions of A direction and B direction in control. The relationship between the thrust moving amount |X| of the fixing unit from the fixing reference position and the thrust moving amount |Y| of the separation claws from the separating reference position is set to |Y|>|X|. An opposing direction of a direction in which the difference of X and Y is generated to the apparatus main body can be set as the thrust moving direction of the sheet in control, and the generated difference can be equal to the thrust moving amount |Z| of the sheet in control. In this case, the thrust moving amount of the separation claws can be increased, damage to the surface of the heating roller by the separation claws can be reduced, and longevity of the heating roller can be improved.

As described above, in the first embodiment, the separation claws 501 and the fixing unit 30 reciprocate in the width direction. In the second embodiment, the separation claws 501 and the conveying roller 402 in a state of nipping the sheet reciprocate in the width direction. That is, the separation claws 501 and at least either the fixing unit 30 or the conveying roller 402 in a state of nipping the sheet reciprocate in the width direction.

On the other hand, in the present embodiment, the conveying roller 402 in a state of nipping the sheet, the fixing unit 30, and the separation claws 501 reciprocate in the width direction. Reciprocating the conveying roller 402, the fixing unit 30, and the separation claws 501 in the width direction can reduce damage to the surface of the heating roller and improve longevity of the heating roller. When the fixing unit 30, the conveying roller 402, and the separation claws 501 are moved, each separation claw 501 is positioned so that the above displacing amount is less than the distance from the sheet side end to the outside end of the separation claw 501 in the width direction. This can prevent the separation claw 501 from being overlapped with the sheet end.

In other words, in the present embodiment, the conveying roller 402 in a state of nipping the sheet, the fixing unit 30, and the separation claws 501 move over a wide range in the width direction. This can keep the contact abrasion of the heating roller 310 to a minimum to improve longevity of the heating roller 310 and can prevent generation of corner folding of the sheet or sheet jam caused by the overlap of each separation claw 501 with the sheet. This enables high-quality deliverables to be provided.

In the foregoing description, a case of conveying the sheet based on the center reference has been taken as an example. However, the present invention is not limited to this but may be applied to a one-side reference, in which the sheet is conveyed using the side end position of the sheet as a reference.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-071781, filed Mar. 29, 2011, which is hereby incorporated by reference herein in its entirety.

What is claimed is:

1. An image forming apparatus comprising:

a fixing unit which has a heating roller and a pressurizing roller pressure contacting with the heating roller, and which fixes a toner image on a sheet onto the sheet at a nip portion between the heating roller and the pressurizing roller;

a separation claw which is provided so as to contact with the heating roller, and which separates the sheet onto which the toner image has been fixed from the heating roller;

a fixing unit moving portion which reciprocates the fixing unit in a width direction perpendicular to a sheet conveying direction;

a separation claw moving portion which reciprocates the separation claw in the width direction;

a displacing amount detecting portion for the fixing unit which detects a displacing amount from a reference position of the fixing unit in the width direction;

a displacing amount detecting portion for the separation claw which detects a displacing amount from a reference position of the separation claw in the width direction; and a control unit which controls driving of the fixing unit moving portion and the separation claw moving portion based on information from the displacing amount detecting portion for the fixing unit and the displacing amount detecting portion for the separation claw so as to satisfy the following relationship, $$L > |X+Y| \ (|X| \leq X0,\ |Y| \leq Y0)$$

wherein a distance between an outside end of the separation claw in the width direction when the fixing unit and the separation claw are at the respective reference positions and a side end of the sheet conveyed at the reference positions in the width direction is L, wherein the displacing amount of the fixing unit detected by the displacing amount detecting portion for the fixing unit is X, wherein a maximum displacing amount of the fixing unit is X0, wherein the displacing amount of the separation claw detected by the displacing amount detecting portion for separation claw is Y, and wherein a maximum displacing amount of the separation claw is Y0.

2. The image forming apparatus according to claim 1, wherein a plurality of the separation claws are provided symmetrically and centering on a center of the heating roller in the width direction, and enables to reciprocate integrally in the width direction.

3. An image forming apparatus comprising:

a fixing unit which has a heating roller and a pressurizing roller pressure contacting with the heating roller, and which fixes a toner image on a sheet onto the sheet at a nip portion between the heating roller and the pressurizing roller;

a separation claw which is provided so as to contact with the heating roller, and which separates the sheet onto which the toner image has been fixed from the heating roller;

a sheet conveying portion which conveys the sheet to the fixing unit;

a sheet conveying portion moving portion which reciprocates the sheet conveying portion in a width direction in a state of nipping the sheet so as to change a position of the sheet to be conveyed to the fixing unit in the width direction perpendicular to a sheet conveying direction;

a separation claw moving portion which reciprocates the separation claw in the width direction;

a displacing amount detecting portion for the sheet conveying portion which detects a displacing amount from a reference position of the sheet conveying portion in the width direction;

a displacing amount detecting portion for the separation claw which detects a displacing amount from a reference position of the separation claw in the width direction; and a control unit which controls driving of the sheet conveying portion moving portion and the separation claw moving portion based on information from the displacing amount detecting portion for the sheet conveying portion and the displacing amount detecting portion for the separation claw so as to satisfy the following relationship, $$L > |Y-Z| \ (|Y| \leq Y0,\ |Z| \leq Z0)$$

wherein a distance between an outside end of the separation claw in the width direction when the sheet conveying portion and the separation claw are at the respective reference positions and a side end of the sheet conveyed at the reference positions in the width direction is L, wherein the displacing amount of the sheet conveying portion is Z, wherein a maximum displacing amount of the sheet conveying portion is Z0, wherein the displacing amount of the separation claw is Y, and wherein a maximum displacing amount of the separation claw is Y0.

4. The image forming apparatus according to claim 3, wherein a plurality of the separation claws are provided symmetrically and centering on a center of the heating roller in the width direction, and enables to reciprocate integrally in the width direction.

5. An image forming apparatus comprising:

a fixing unit which has a heating roller and a pressurizing roller pressure contacting with the heating roller, and which fixes a toner image on a sheet onto the sheet at a nip portion between the heating roller and the pressurizing roller;

a separation claw which is provided so as to contact with the heating roller, and which separates the sheet onto which the toner image has been fixed from the heating roller;

a sheet conveying portion which conveys the sheet to the fixing unit;

a sheet conveying portion moving portion which reciprocates the sheet conveying portion in a width direction in a state of nipping the sheet so as to change a position of the sheet to be conveyed to the fixing unit in the width direction perpendicular to a sheet conveying direction;

a fixing unit moving portion which reciprocates the fixing unit in the width direction;

a separation claw moving portion which reciprocates the separation claw in the width direction;

a displacing amount detecting portion for the sheet conveying portion which detects a displacing amount from a reference position of the sheet conveying portion in the width direction;

a displacing amount detecting portion for the fixing unit which detects a displacing amount from a reference position of the fixing unit in the width direction;

a displacing amount detecting portion for the separation claw which detects a displacing amount from a reference position of the separation claw in the width direction; and a control unit which controls driving of the sheet conveying portion moving portion, the fixing unit moving portion and the separation claw moving portion based on information from the displacing amount detecting portion for the sheet conveying portion, the displacing amount detecting portion for the fixing unit and the displacing amount detecting portion for the separation claw so as to satisfy the following relationship, $$L>|(X+Y)-Z| \quad (|X|\leq X0,\ |Y|\leq Y0,\ |Z|\leq Z0)$$

wherein a distance between an outside end of the separation claw in the width direction when the sheet conveying portion, the fixing unit and the separation claw are at the respective reference positions and a side end of the sheet conveyed at the reference positions in the width direction is L, wherein the displacing amount of the sheet conveying portion is Z, wherein a maximum displacing amount of the sheet conveying portion is Z0, wherein the displacing amount of the fixing unit is X, wherein a maximum displacing amount of the fixing unit is X0, wherein the displacing amount of the separation claw is Y, and wherein a maximum displacing amount of the separation claw is Y0.

6. The image forming apparatus according to claim 5, wherein a plurality of the separation claws are provided symmetrically and centering on a center of the heating roller in the width direction, and enables to reciprocate integrally in the width direction.

* * * * *